US005683009A

United States Patent [19]

King

[11] Patent Number: 5,683,009

[45] Date of Patent: Nov. 4, 1997

[54] ACCESSORIES TO ENHANCE THE RECYCLABILITY OF METAL CANS

[76] Inventor: Randy A. King, 10560 Monticello Dr., Pinckney, Mich. 48169

[21] Appl. No.: 665,315

[22] Filed: Jun. 17, 1996

[51] Int. Cl.[6] ..... B65D 25/42

[52] U.S. Cl. ..... 220/696; 220/697; 220/700; 220/710.5; 220/736; 220/741

[58] Field of Search ..... 220/741, 736, 220/735, 700, 701, 742, 739, 696, 697, 710.5

[56] References Cited

U.S. PATENT DOCUMENTS

| | | | |
|---|---|---|---|
| 592,012 | 10/1897 | Lewis . | |
| 1,698,403 | 1/1929 | Harris | 220/736 |
| 2,010,317 | 8/1935 | Olson | 220/94 |
| 2,094,869 | 10/1937 | Ballard | 65/13 |
| 2,533,355 | 12/1950 | Comfort | 220/736 |
| 2,783,077 | 2/1957 | Pierce | 220/736 |
| 2,873,052 | 2/1959 | Atherton | 220/700 |
| 2,873,881 | 2/1959 | Nichols | 220/701 |
| 2,911,016 | 11/1959 | Kenney | 220/700 |
| 3,014,621 | 12/1961 | Povitz | 222/183 |
| 3,029,975 | 4/1962 | Aiello | 220/85 |
| 3,074,678 | 1/1963 | Mele . | |
| 3,688,943 | 9/1972 | Brown | 220/90 |
| 3,811,606 | 5/1974 | Higgins | 222/570 |
| 3,979,011 | 9/1976 | Schleicher | 220/94 R |
| 3,998,352 | 12/1976 | Hopkins | 220/90 |
| 4,127,211 | 11/1978 | Zerbey | 220/212 |
| 4,203,537 | 5/1980 | McAlister | 222/570 |
| 4,312,459 | 1/1982 | Leach | 220/700 |
| 4,369,890 | 1/1983 | Bennett | 220/85 |
| 4,757,568 | 7/1988 | Jones | 220/736 |
| 4,898,297 | 2/1990 | Wheeler | 220/85 |
| 5,255,814 | 10/1993 | Delagera | 220/352 |
| 5,316,169 | 5/1994 | Gallagher | 220/355 |
| 5,505,330 | 4/1996 | Nunes | 220/742 |
| 5,568,879 | 10/1996 | Kovathana | 220/700 |
| 5,582,321 | 12/1996 | Urbanczyk | 220/739 |
| 5,597,190 | 1/1997 | DeMars | 294/33 |

*Primary Examiner*—Joseph M. Moy

*Attorney, Agent, or Firm*—Gifford, Krass, Groh, Sprinkle, Patmore, Anderson & Citkowski

[57] ABSTRACT

Small, lightweight metal cans such as coffee or peanut cans are easily recycled but are frequently not recycled or reused. One secondary use of these metal cans is for painting applications such as trim painting. The accessory disclosed herein enables metal cans of the aforementioned type, typically having a continuous bead around the apex end of the can, to be easily utilized for such painting applications. The reusable accessory comprises a handle having an upper and lower end and a grippable portion disposed between them. A lid is hingedly attached to the upper end of the handle, the lid having an upper and lower surface, the lower surface having at least one continuous lip suitable to engage the bead of the can. Additionally, the lid has a cutout through which a paint brush may pass which is particularly configured so as to enable a paint brush to hang suspended in the can from the lid. The can is secured to the handle by a variety of mechanisms.

18 Claims, 4 Drawing Sheets

ACCESSORIES TO ENHANCE THE RECYCLABILITY OF METAL CANS

FIELD OF THE INVENTION

The present invention relates generally to container accessories and, more particularly, to a reusable attachable lid and handle system to enhance the recyclability and usability of small, lightweight metal cans for various applications, including painting.

BACKGROUND OF THE INVENTION

Small, lightweight metal cans such as coffee cans and peanut cans are frequently not recycled or reused, despite the fact that such containers could be used in a variety of secondary purposes given the proper accessory. Unfortunately, the metal cans lack a handle, lid, scraping surface and other features which renders the can difficult to use in painting applications.

There exists a number of devices which are intended to enhance the usability of a paint cans, however most of these are intended for use with the original paint container, and are directed toward preventing paint from entering the rim channel of conventional paint cans, or toward enhancing the sealability and pourability of conventional paint cans. Typical devices are disclosed in U.S. Pat. Nos. 3,688,943 to Brown; 3,811,606 to Higgins; 3,998,352 to Hopkins; 4,203,537 to McAlister; 4,369,890 to Bennett; 5,255,814 to Delagera; and 5,316,169 to Gallagher.

These prior art devices are not directed towards enhancing the recyclability of small, lightweight metal cans for painting applications, but rather are directed toward improving the usability of the container in which the paint is sold to the consumer. Thus, the problems in the prior art regarding reusability of small, lightweight metal cans remain unresolved.

SUMMARY OF THE INVENTION

The present invention solves the problems of recyclability and reusability of small, lightweight metal cans such as coffee or peanut cans by providing a reusable accessory attachable to the metal can which enables the metal can to be easily utilized in painting applications, in particular staining and trim painting applications.

Metal cans of the type considered here comprise an open end and a contiguous wall having an outer surface, the wall being folded outwardly and onto itself at the open end of the can to form a bead extending around the outer surface at the open end of the can.

The reusable accessory comprises a handle having an upper and lower end and a grippable portion disposed between the upper and lower ends. A lid is attached to the upper end of the handle by a hinge or other connecting means, such as a tongue and fork arrangement. The lid has an upper surface and a lower surface and at least one continuous lip on the lower surface of the lid. Each continuous lip is constructed to engage the bead on the outer surface of a can having a particular perimeter. Additionally, the lid has a cutout sufficiently large to permit a paint brush to pass through and is particularly configured so as to enable a brush to hang suspended in the can from the cutout in the lid. The metal can is secured to the handle by a variety of mechanisms. Preferred embodiments include a base hingedly attached, via a tongue and fork arrangement or plastic "living" hinge, to the lower end of the handle whereby the base supports the weight of the can and pivots upwardly toward the handle for storage; a strap encircling the can and having a proximate end attached to the handle, an aperture at its distal end which engages a hook positioned on the lower end of the handle; flanges extending outwardly from the handle, whereby the outside of the metal can is in contact with the inside surface of the flanges, and the outside surface of the flanges having hooks such that flexible bands may encircle the metal can and be secured to the hooks.

The upper end of the handle may further comprise an inner member which is slidably received in the upper end, the lid being attached to the inner member such that the distance between the lid and the lower end of the handle may be adjusted. This embodiment permits use of a fixed base to support the weight of the can, while permitting the accessory to be adjustable to accommodate cans of different heights.

Additionally, the grippable portion of the handle may have, at its upper end, a thumb rest so as to enhance usability and comfort to the user. The grippable portion may also have, on one side, four curved detents enabling the fingers of a hand to fit comfortably within the curved detents, the opposing side of the grippable portion being curved outwardly to conform to the curved palm of the user.

In an alternate embodiment, a downwardly sloping bevel, adjacent to the cutout in the lid, is provided to enhance the usability of the lid for scraping excess paint off the paint brush.

DETAILED DESCRIPTION OF THE PREFERRED EMBODIMENT

Figure 1:
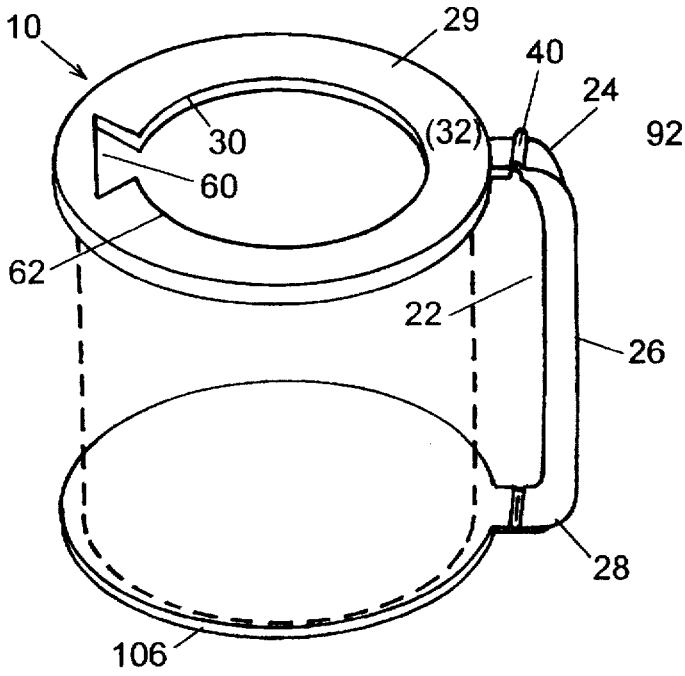
FIG. 1 is a perspective view of an accessory according to the invention.

The invention, as shown in FIG. 1, is an accessory, shown generally at 10, to enhance recyclability and reusability of a small, lightweight metal can in painting operations such as trim painting. As best disclosed in FIG. 2, prior art metal cans of the type considered for use in this invention typically have an open end 14 and a contiguous wall 16 having an outer surface 18, wall 16 being folded outwardly onto itself at the open end of can 12 to form a bead 20 extending around outer surface 18 of can 12. Small, lightweight metal cans of this type are frequently sold to consumers containing coffee, peanuts or the like and may have circular, square or rectangular cross-sections. While these cans are intended to be recycled, they are not frequently recycled or reused.

As depicted in FIG. 1, accessory 10 comprises handle 22 having upper end 24, lower end 28, and grippable portion 26 disposed between upper end 24 and lower end 28. Lid 29 is attached to upper end 24 of handle 22 by a variety of connecting means, the embodiment depicted in FIG. 1 disclosing use of a plastic hinge 40 being sufficiently thin so as to be capable of repeated flexing. A living hinge such as hinge 40 may be utilized when lid 29 and handle 22 are manufactured as a unitary body of plastic.

Figure 2:
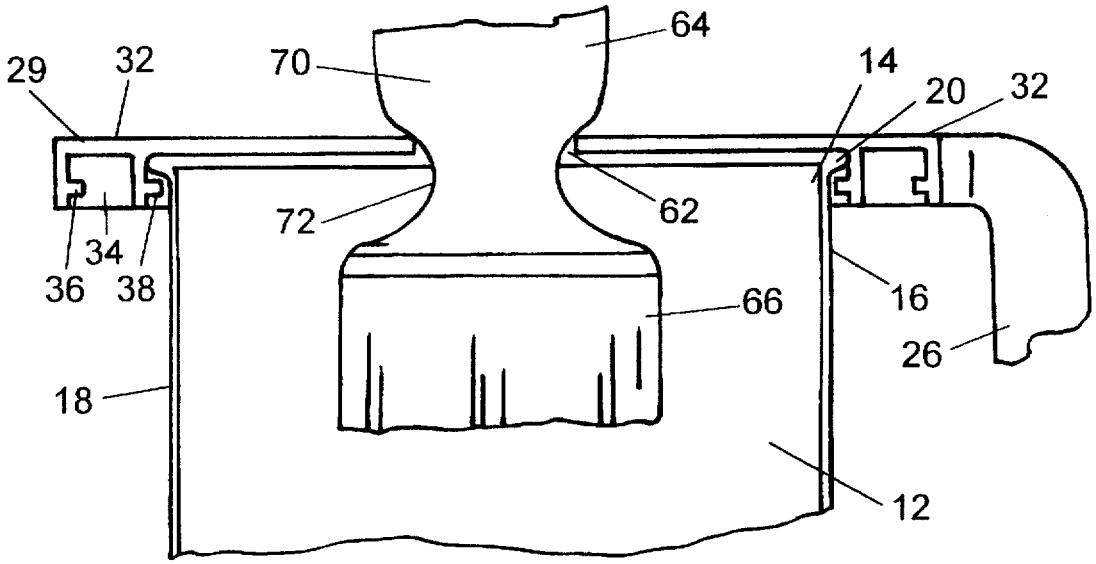
FIG. 2 is a cutaway view of an alternate embodiment of a lid according to the present invention.

As best depicted in FIG. 2, the lower surface 34 of lid 29 has at least one continuous lip 36, 38 suitable to engage bead 20 on outer surface 18 of can 12. Lid 29 has a cutout 30 comprising two contiguous openings 60 and 62, such that paint may be applied to the brush 64 through opening 60, and the brush 64 may be suspended in opening 62 by placing the narrow section 72 of brush handle 68 within opening 62 such that bristle end 66 is disposed within can 12 and the wider section 70 of brush handle 68 rests upon upper surface 32 of lid 29. As disclosed in the figures and discussed below, a wide variety of mechanisms may be utilized for securing can 12 to lower end 28 of handle 22.

Thus, a small, lightweight metal can 12 may be inserted into accessory 10 such that lip 36 on lower surface 34 of lid 29 engages bead 20 on can 12, and handle 26 is secured at its lower end 28 to can 12, thereby providing support to maintain the can 12 in contact with accessory 10. Once accessory 10 is affixed to can 12, paint brush 64, typically being less than 3 inches wide, may be inserted into cutout 30 to contact paint contained within can 12, and withdrawn through cutout 30 for painting. When not in use, handle 68 of brush 64 may be placed in opening 62 such that bristle end 66 of brush 64 is suspended within the interior of can 12, and wider section 70 of handle 68 rests upon upper surface 32 of lid 29. Although not shown, the metal can's original lid may be utilized to seal the paint within the can 12 after accessory 10 has been removed.

In a preferred embodiment of the invention, lip 38 is suitable to engage a can 12 having a four inch diameter, and lip 36 is suitable to engage a can 12 having a five inch diameter, though lips having smaller and/or larger diameters are readily accommodated by the invention. Additionally, lip 36 or 38 may be configured to accept cans having various shapes, for example, lip 38 shaped to accommodate a generally rectangular can having a maximum length of 4 inches, while lip 36 may be configured to snap on a generally circular can having a 6 inch diameter.

Figure 4B:
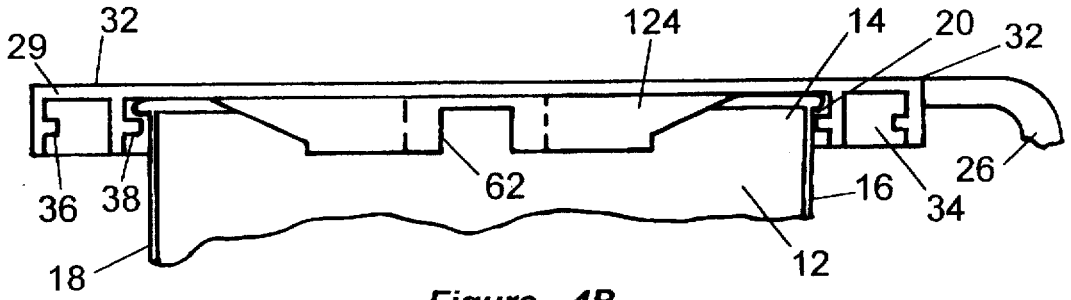
FIG. 4B is an cross-sectional view of FIG. 4A along lines 4B—4B.
Figure 4A:
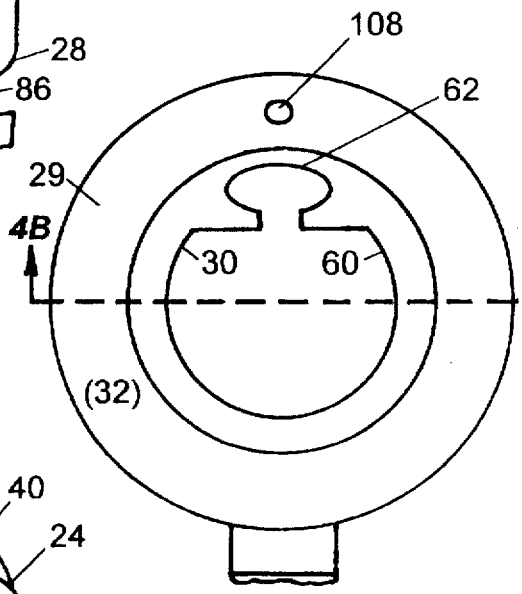
FIG. 4A discloses an alternate embodiment of the lid.

The cutout 30 in lid 29 is best disclosed in FIGS. 1, 4A and 4B. The smaller opening 62 may be shaped as a circle, oval, trapezoid, or key-hole, and provides a place to temporarily store brush 64, rather than setting brush 64 into paint, which may result in undesired paint on surfaces of brush 64 such as the handle 68 or upper bristles. The larger opening 60 provides access to the paint contained in can 12 from exteriorly of can 12, and may be circular, trapezoidal, square, rectangular, triangular or other suitable shape. In the alternate embodiment depicted in FIGS. 4A and 4B, lid 29 further comprises a bevel 124 positioned between upper surface 32 of lid 29 and cutout 30.

Figure 5:
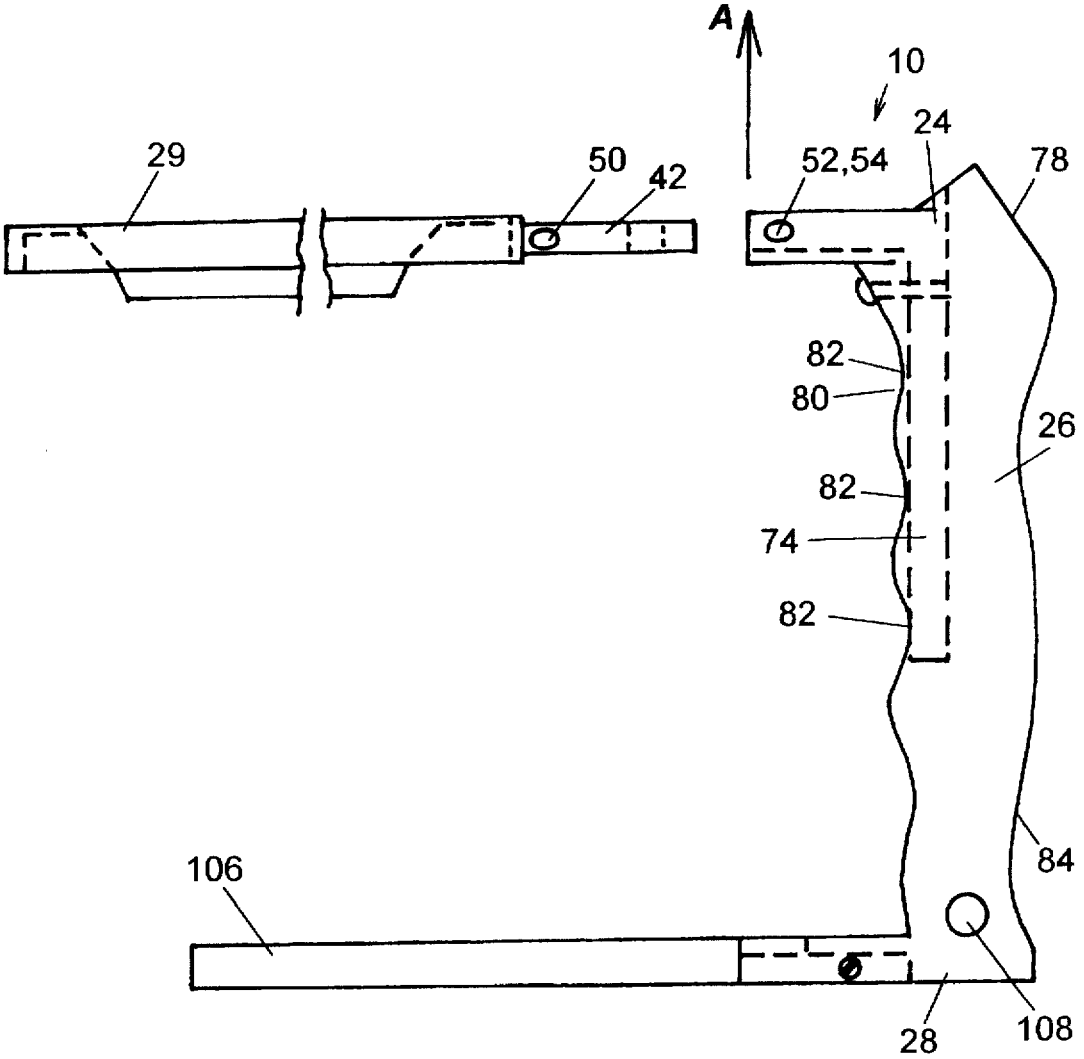
FIG. 5 discloses an alternate embodiment of the invention.

In an alternate embodiment depicted in FIG. 5, accessory 10 may further comprise an inner member 74 slidably received in upper end 24 of handle 22 so as to slide in a vertical manner as indicated by arrow A. Lid 2 is attached to inner member 74 utilizing any of the connecting mechanisms disclosed to connect lid 29 or base 106 to handle 22. The sliding inner member 74 permits adjustment of the distance between lid 29 and base 106, enabling accessory 10 to accommodate metal cans of various heights.

Figure 3:
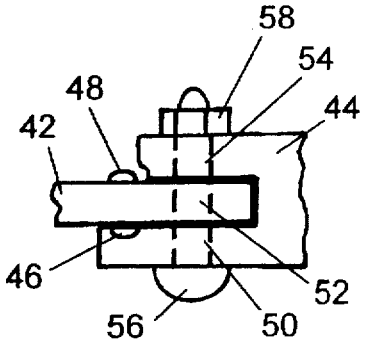
FIG. 3 is an alternate embodiment of a hinging means disposed between the lid and handle or base and handle.

As best depicted in FIGS. 1, 5, 6B, 7 and 8, different mechanisms may be utilized for securing can 12 to lower end 28 of handle 22. As depicted in FIG. 1, base 106 is attached to handle 22 by means of a plastic hinge such as that depicted by hinge 40, being sufficiently thin so as to be capable of repeated flexing. In FIG. 5, base 106 is attached to lower end 28 of handle 22 by a tongue and fork arrangement, similar to that utilized to secure lid 29 to the upper end 24 of handle 26. The tongue and fork arrangement may be constructed of a variety of materials, including plastics and metals. Tongue 42 is positioned between the two arms of fork 44. In an alternate embodiment, tongue 42 is snappably received and secured within fork 44 by a pair of detents 46 in fork 44, each detent 46 mating pivotably with button 48, as shown in the cutaway view of FIG. 3. Tongue 42 and fork 44 have bores 50, 52 and 54 such that when lid 29 is roughly perpendicular to handle 22, or alternatively when base 106 is perpendicular to handle 22, bores 50, 52 and 54 are aligned such that screw 56 is receivable in and passes through bores 50, 52 and 54 such that the distal end of screw 56 extends beyond the tongue and fork arrangement, and nut 58 may be threadably engaged onto the distal end of screw 56. This arrangement permits the tongue and fork to be rotatable about the detent 46 and button 48 when screw 56 is not engaging bores 50, 52 and 54. Once screw 56 engages bores 50, 52 and 54, lid 29, or alternatively base 106, is fixed at a desired angle to handle 22.

Figure 6A:
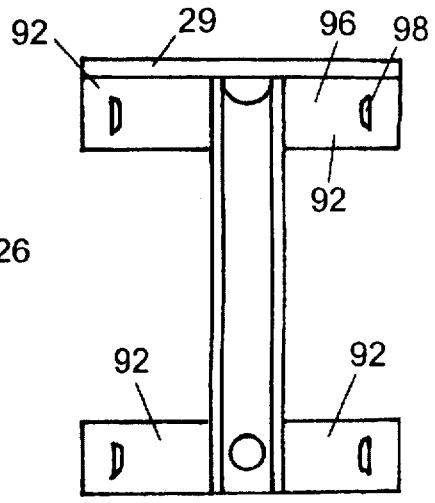
FIGS. 6A and 6B show another alternate embodiment of the invention.
Figure 6B:
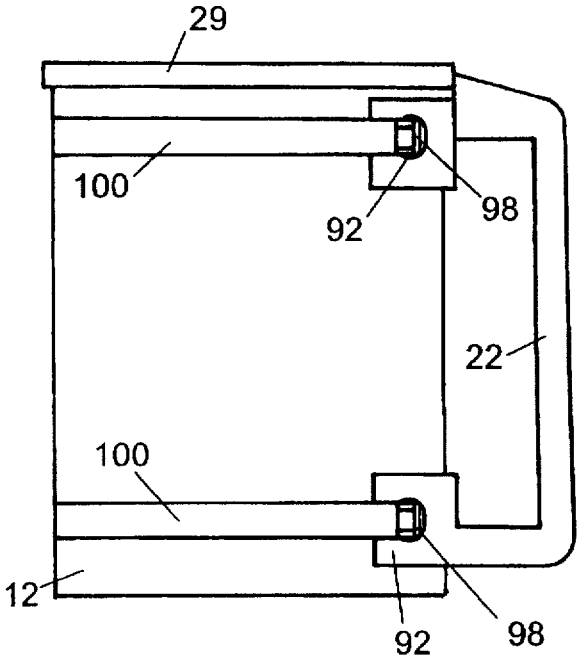

In FIG. 6B, handle 22 includes a plurality of arcuate flanges 92 projecting outwardly. Each flange 92 has an outer surface 96 and an inner surface (not shown) which is adjacent outer surface 18 of metal can 12. FIG. 6A depicts accessory 10 without metal can 12. In FIG. 6B, two stretchable bands 100 encircle outer surface 18 of metal can 12 and are releasably hooked to outwardly projecting bosses 98 such that band 100 is in tension, thereby holding metal can 12 against flanges 92. Alternate embodiments not pictured include a single flange extending the length of handle 22, the flange having a plurality of bosses, as well as an embodiment whereby three or more flanges are located at varying positions along handle 22. Alternate methods of securing the bands 100 to the flanges 92 includes inserting the ends of bands 100 through apertures in the flanges 92, thereby permitting retention of bands 100 thereby reducing the occurrence of misplaced bands while permitting worn-out bands to be replaced. In an alternate embodiment, a one-piece stretchable band may be expanded to encompass the handle 22 and/or flanges 92 and can 12, then permitting the band to contract, thereby holding can 12 against handle 22 or flanges 92.

Figure 7:
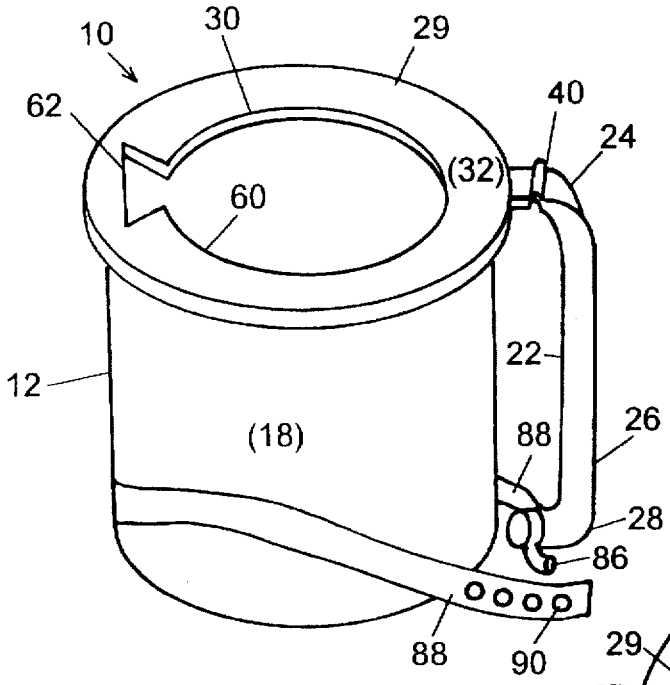
FIG. 7 shows yet another alternate embodiment of the invention.

FIG. 7 depicts yet another alternate embodiment permitting metal can 12 to be secured to accessory 10, whereby hook 86 is positioned proximate to lower end 28 of handle 22. A flexible strap 88 extends outwardly from lower end 28 of handle 22 and encircles outer surface 18 of can 12. Strap 88 has at least one aperture 90 being suitably sized to mate to hook 86. Once strap 88 encircles can 12 and aperture 90 is mated to hook 86, metal can 12 will be secured to handle 22.

Figure 8:
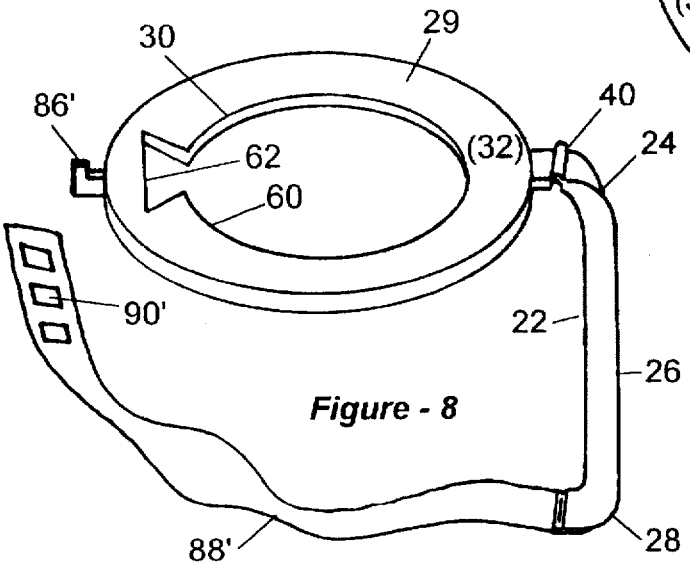
FIG. 8 shows still another alternate embodiment of the invention.

FIG. 8 depicts an alternate embodiment whereby strap 88' extends from lower end 28 of handle 22, extending upwardly toward lid 29, strap 88' being sufficiently long so as to enable it to pass beneath can 12 while permitting aperture 90' to engage hook 86' which is located distally of handle 22 on lid 29.

Accessory 10 is preferably molded of plastic such as polyethylene, polypropylene or other suitable material. Selected embodiments may comprise portions of plastic and metal, such as the embodiment depicted in FIG. 5. Base 106, hingedly attached to lower end 28 of handle 22 by a tongue and fork arrangement permits base 106 to be manufactured of metal or another material dissimilar to the material comprising handle 22. Alternatively, handle 22 may be comprised of metal, with base 106 also comprised of metal and lid 29 constructed of plastic. The various features disclosed herein enable one skilled in the art to combine the particular features disclosed in a wide variety of alternate embodiments.

As depicted in FIGS. 4A, 5 and 6A, a hole 108 may be provided to enable accessory 10 to be hung from a hook or other projection, to enhance storability of accessory 10.

Having described the various embodiments of the present with reference to the accompanying figures, it will be appreciated that various changes and modifications can be made without departing from the scope or spirit of the invention.

What is claimed is:

1. An accessory to enhance the recyclability of a metal can of the type having an open end of at least four inches in diameter, a contiguous side wall with inner and outer surfaces, and a contiguous side wall with inner and outer surfaces, and a continuous bead protruding outwardly from the outer surface around the open end of the can, the accessory comprising:

a handle having an upper end, a lower end, and a grippable portion disposed therebetween;

means for securing the lower end of the handle to the can; and a lid attached to the upper end of the handle, the lid including an upper surface, a lower surface, and a central aperture sufficiently large to permit a paint brush to pass therethrough and interiorly into the can, the aperture being defined by a peripheral edge spaced apart from the inner wall of the can to permit the brush carrying paint to be scraped thereagainst, the lower surface including a continuous lip physically configured to engage with the bead on the outer surface of the can, the lip including an annular member having an inner wall which extends downwardly form the bottom surface and past the outer edge of the bead and a rim extending radially inwardly from the bottom extent of the annular member, thereby creating a circular groove which interlockingly receives the bead of the can.

2. The accessory as claimed in claim 1, wherein the lid and handle are manufactured as a unitary body of plastic, the connecting means comprising a hinge being sufficiently thin so as to be capable of repeated flexing.

3. The accessory as claimed in claim 1, wherein the connecting means between the lid and the handle comprises a tongue and fork arrangement, the tongue being snappably secured within the fork.

4. The accessory as claimed in claim 1, wherein the connecting means comprises a tongue and fork arrangement, the tongue and fork each having bores such that, when the lid is roughly perpendicular to the handle, the bores are aligned, a screw having a distal end, the screw receivable in and passing through the bores such that the distal end of the screw extends beyond the tongue and fork arrangement, and a nut threadably engaged on the distal end of the screw.

5. The accessory as claimed in claim 1, wherein the lower surface of the lid has two continuous lips, the first lip suitable to engage a can having a 5 inch diameter, the second lip suitable to engage a can having a 4 inch diameter.

6. The accessory as claimed in claim 1, wherein the cutout comprises a first opening sufficiently large to permit a paint brush to pass through, a second opening, contiguous with and smaller than the first opening, such that a paint brush having a bristle end and a brush handle, the brush handle having a wide and narrow section, whereupon the narrow section of the brush handle is disposed between the wide section of the brush handle and the bristle end, the second opening being larger than the narrow section of the brush handle and smaller than the wider section of the brush handle such that, upon insertion of the narrow section of the brush handle into the second opening, the wider section of the brush handle rests on the lid, the bristle end thereby suspended below the lid.

7. The accessory as claimed in claim 6, wherein the first opening is roughly circular and the second opening is roughly trapezoidal.

8. The accessory as claimed in claim 1, the upper end of the handle further comprising an inner member slidably received in the upper end, the connecting means attached to the inner member of the upper handle such that the distance between the lid and means for securing the can may be adjusted.

9. The accessory as claimed in claim 1, the grippable portion of the handle having an upper end and a thumb rest positioned at the upper end of the grippable portion, the grippable portion also having two opposing sides, one side having four curved detents such that fingers of a hand may be comfortably fit within the curved detents, the opposing side being curved outwardly to conform to a palm of the hand.

10. The accessory as claimed in claim 1, wherein the means for securing the can comprises a hook positioned on the handle, a flexible strap having at least one aperture, the strap extending outwardly from the handle such that the strap encircles the outer surface of the can, the aperture mating to the hook.

11. The accessory as claimed in claim 1, wherein means for securing the can comprises a plurality of arcuate flanges projecting outwardly from the handle, each flange having an inner and outer surface, the inner surface of each flange adjacent to the outer wall of the can, the outer surface of each flange having at least one outwardly projecting boss.

12. The accessory as claimed in claim 11, wherein means for securing the can comprises four flanges, two attached proximate to the upper end of the handle, and two attached proximate to the lower end of the handle.

13. The accessory as claimed in claim 11 or 12, further including a plurality of flexible stretchable bands, each band encircling the outer wall of the can and releasably hooked to outwardly projecting bosses such that the band is in tension.

14. The accessory as claimed in claim 1, the lid further comprising a hook located distally of the handle, means for securing the can comprising a flexible strap having at least one aperture, the strap projecting outwardly and downwardly from the lower end of the handle, the strap being sufficiently long so as to enable it to pass beneath the can while permitting the aperture to engage the hook.

15. The accessory as claimed in claim 1, means for securing the can comprising a base hingedly attached to the lower end of the handle.

16. The accessory as claimed in claim 15, the can further comprising a bottom, the area of the base being greater than the area of the bottom of the can.

17. The accessory as claimed in claim 15, the base hingedly attached to the handle by a tongue and fork arrangement, the tongue and fork each having bores such that, when the lid is roughly perpendicular to the handle, the bores are aligned, a screw having a distal end, the screw receivable in and passing through the bores such that the distal end of the screw extends beyond the tongue and fork arrangement, and a nut threadably engaged on the distal end of the screw.

18. The accessory as claimed in claim 1, wherein the lid further comprises a bevel disposed adjacent to the cutout such that the upper surface adjoins the bevel which slopes toward the cutout.

* * * * *

UNITED STATES PATENT AND TRADEMARK OFFICE

CERTIFICATE OF CORRECTION

PATENT NO. : 5,683,009

DATED : November 4, 1997

INVENTOR(S) : King

It is certified that error appears in the above-indentified patent and that said Letters Patent is hereby corrected as shown below:

Claim 1, lines 4-5: Delete "and a contiguous side wall with inner and outer surfaces,".

Claim 1, line 22: Replace "form" with --from--.

Signed and Sealed this

Seventeenth Day of February, 1998

*Attest:*

Bruce Lehman

BRUCE LEHMAN

*Attesting Officer*

*Commissioner of Patents and Trademarks*